US009988246B2

(12) United States Patent
Illana Martos et al.

(10) Patent No.: US 9,988,246 B2
(45) Date of Patent: Jun. 5, 2018

(54) ELASTIC FINS FOR CONTAINER COUPLING ELEMENTS

(71) Applicant: INDUSTRIA ALGECIRENA DE MECANIZADOES Y REPARACIONES, S.L. (INAMER), Algeciras, Cadiz (ES)

(72) Inventors: Antonio Illana Martos, Cadiz (ES); Jose Maria Blanco Salas, Cadiz (ES)

(73) Assignee: INDUSTRIA ALGECIRENA DE MECANIZADOS Y REPARACIONES, S.L. (INAMER), Algeciras, Cadiz (ES)

( * ) Notice: Subject to any disclaimer, the term of this patent is extended or adjusted under 35 U.S.C. 154(b) by 0 days. days.

(21) Appl. No.: 15/117,346

(22) PCT Filed: Feb. 6, 2015

(86) PCT No.: PCT/ES2015/000019
§ 371 (c)(1),
(2) Date: Aug. 29, 2016

(87) PCT Pub. No.: WO2015/128517
PCT Pub. Date: Sep. 3, 2015

(65) Prior Publication Data

US 2016/0376131 A1 Dec. 29, 2016

(30) Foreign Application Priority Data

Feb. 27, 2014 (ES) ..... 201400172

(51) Int. Cl.
*B66C 1/66* (2006.01)
*B65D 90/00* (2006.01)

(52) U.S. Cl.
CPC ..... *B66C 1/663* (2013.01); *B65D 90/0013* (2013.01)

(58) Field of Classification Search
CPC ..... B66C 1/663; B65D 90/0013
USPC .. 294/81.21, 81.41, 81.53, 81.4, 81.5, 81.54
See application file for complete search history.

(56) References Cited

U.S. PATENT DOCUMENTS 3,078,115 A 2/1963 Harlander et al.
3,453,017 A * 7/1969 Nagy ..... B66C 1/101 294/81.41
3,885,676 A 5/1975 Wilson et al.
3,992,050 A * 11/1976 Backteman ..... B66C 1/663 294/81.21
5,354,112 A 10/1994 Hara et al.
(Continued)

FOREIGN PATENT DOCUMENTS

ES 2396305 T3 8/2007

OTHER PUBLICATIONS

International Search Report dated Apr. 20, 2015 for PCT/ES2015/000019.

*Primary Examiner* — Paul T Chin
(74) *Attorney, Agent, or Firm* — Lucas & Mercanti, LLP

(57) ABSTRACT

The flippers consist of a new type of flippers which operate as a rigid assembly in the usual operation thereof, but which elastically yield against impacts and overloads, recovering the usual operation afterwards. This flexibility is achieved two ways, which exclusively affect the flipper itself, not the connection thereof with the spreader or the possible driving system thereof. Mainly: use of elastic materials and use of geometries which are stable against service loads but are readily deformed against impacts.

8 Claims, 9 Drawing Sheets

(56) References Cited

U.S. PATENT DOCUMENTS

Figure 1:
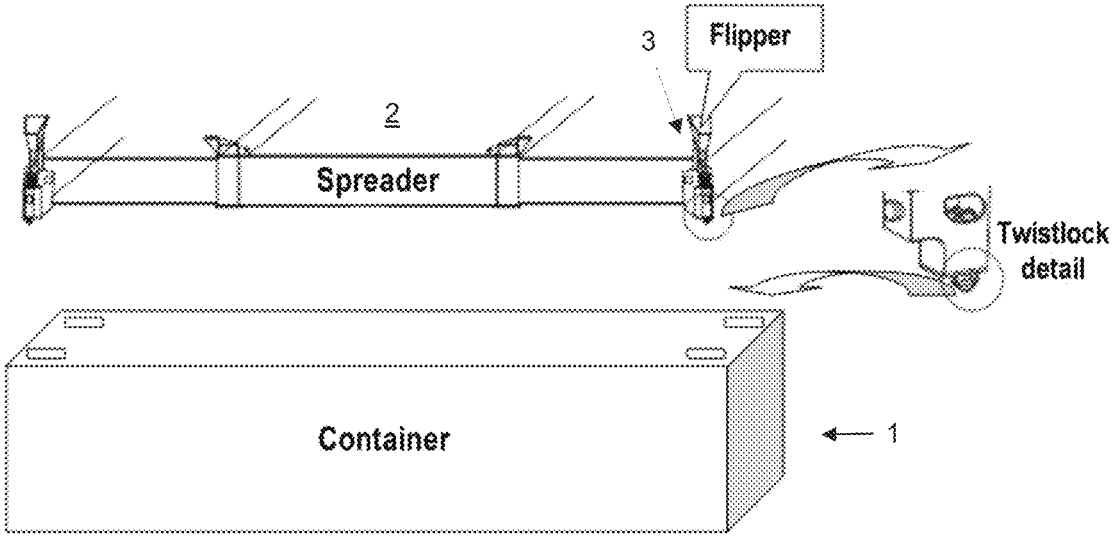

| | | | | |
|---|---|---|---|---|
| 6,161,887 | A | 12/2000 | Shiota et al. | |
| 6,588,814 | B2 * | 7/2003 | Miyazawa | B66C 1/101 294/81.21 |
| 6,863,325 | B1 * | 3/2005 | Mills | B66C 1/102 294/81.21 |
| 7,690,707 | B2 * | 4/2010 | Stinis | B66C 1/102 294/81.1 |
| 8,840,159 | B2 * | 9/2014 | Karlsson | B66C 1/102 294/81.21 |
| 2004/0100111 | A1 * | 5/2004 | Stinis | B66C 1/663 294/81.21 |
| 2004/0189031 | A1 * | 9/2004 | Zhu | B66C 1/663 294/81.1 |
| 2009/0102213 | A1 * | 4/2009 | Ritchie | B66C 1/12 294/74 |
| 2009/0200814 | A1 | 8/2009 | Hellgren | |
| 2011/0140470 | A1 | 6/2011 | Mills et al. | |

* cited by examiner

ELASTIC FINS FOR CONTAINER COUPLING ELEMENTS

CROSS REFERENCE TO RELATED APPLICATION

This Application is a 371 of PCT/ES2015/000019 filed on Feb. 6, 2015, which claims priority of Spanish Application No. P201400172 filed Feb. 27, 2014, both of which are incorporated herein by reference.

Technical Field

Area of knowledge: Mechanical engineering, Mechanism design sections, Materials and Lifting devices technology, Transport and Handling.

Industrial Activity: multimodal transport, container transport, latching and handling of containers.

State of the Art

The majority of solid cargoes which travel around the world are distributed by means of containers transported by ship, road or railway. The containers are latched for the lifting, loading, unloading and stacking thereof by using engaging elements provided with simple latching mechanisms at their ends. The usual term for the engaging element is "spreader" and the latches are locks referred to as "twistlocks". See FIG. 1.

In principle, the latching operation is very simple, consisting of simply positioning the spreader just above the container, in contact with the upper face thereof and then rotating the twistlocks so that the engagement is produced. However, the part protruding from the twistlocks are stubs, the size of which (a few centimeters) is very small compared to the container dimensions (six or twelve meters the most common ones). Usually, they are outside the field of vision of the crane operator and the operation is performed at five, twenty or more meters away from the crane operator. See FIG. 2.

Consequently, it is essential to provide a centering system guiding the spreader on the container, guaranteeing the corners of both of them to match so that the stub fits exactly in the small socket in the container prepared therefor, also known as corner casting.

The habitual centering system is that performed by means of fins, mostly known as flippers. They are centering elements made of an inclined steel sheet which are arranged at the corners or sides of the spreader and allow overcoming small misalignments.

It is usual that these flippers are collapsible ones, with a centering position for engagement and another retracted for the container stacking. This feature does not affect the idea disclosed in this patent application, which can be used both for retractable and fixed flippers.

It is important, at this point, to mention operational dimensions and speeds. The standard container can weigh from a pair of tons (tare weight) to more than eighty. The spreader weight is also in the range of tons. The spreader is lowered down upon the cargo from a height of several meters, sometimes vertically and more often angled, moving the cargo at more than thirty meters high and fifty meters horizontally. That is, we are facing an operation wherein the search for productivity leads to high speeds and very low latching times. The crane operator, in order to speed up production, must convey the spreader following a curve at a very high speed, instead of stabilizing it on top of the cargo and slowly lower it down vertically. This makes the flippers to undergo strong impacts with the containers, both on the sides and from below. See FIGS. 3 and 4.

The consequences of the impacts entail damage to the containers, the spreader, the cargo, hazards for people, and most often, the flippers denting or breaking, with the subsequent corrective maintenance and the possible loss of profit when an essential machine is affected.

Figure 5:
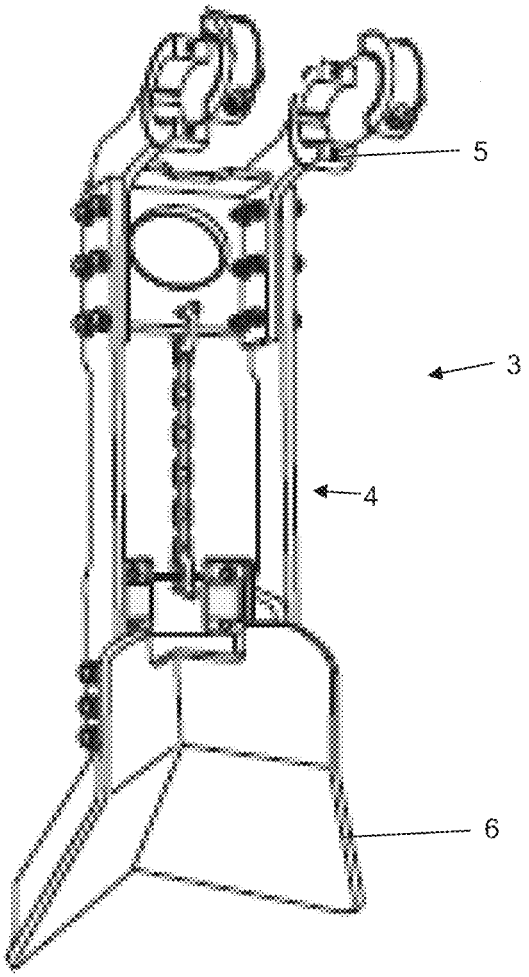

FIG. 5 shows a flipper in the centering position thereof. In this case, it is not made in a single piece but, instead, it is formed by three different pieces screwed to each other: a central area 4 or spring plate, a first end 5 attachable to the spreader 2, and a second end 6 acting as centering elements over the container 1. In any case, everything is made of steel, both the wide portion which is itself used as the guide, the top portion fastening the flipper to the spreader (being motor driven for it to be remotely moved), and the central area 4 or spring plate connecting them.

Figure 6:
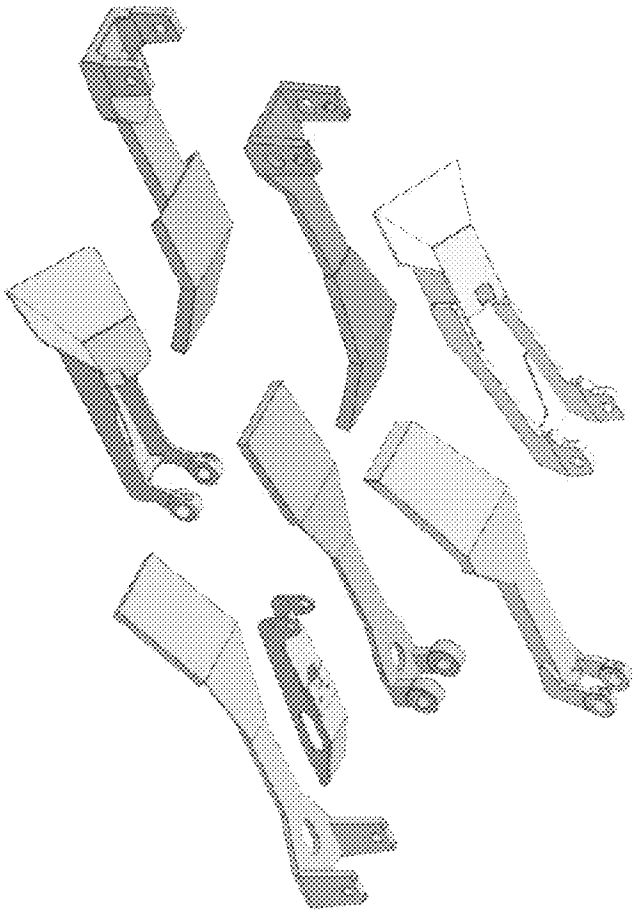

FIG. 6 shows different flipper models. All of them are rigid and made of steel.

Upon searching the prior literature and patents, it is observed that the problems with impacts have been previously dealt with, but from the drive system perspective.

That is the case of patent E08774959 from the $10^{th}$ of Jul. of 2008, "Spreader for accommodating containers" (Spanish version EP 2188202 from the $28^{th}$ of Nov. of 2012), which claims the use of a shock absorbing coupling being coupled to a polygonal shaft, coupled in turn to an elastic polygonal seat. This refers to the shaft, the rotation of which generates the flipper to fold, something which is not at all dealt with herein, where reference is made to the flipper itself.

Patents disclosing spreaders models, stackers or twistlocks drives or flipper drives are frequent. An example is found in patent US 2011/0140470 A1 "Spreader with flipper arm drive" to R. A. Mills et al., which, as its title indicates, refers to the flipper arm drive. There is a wide range of geometries for the flippers, as it is shown in FIG. 6. However, in all the cases it is supposed that the centering flipper should be a rigid element, made of steel in practice, either in one piece, welded or screwed but always forming a single rigid kinematic link.

DESCRIPTION OF THE INVENTION

The technical preconception overcome by this invention is the idea that flippers for spreaders 2 must be a rigid element.

The present invention consists of a new type of flippers 3 for container spreaders 2 provided with a significant flexibility, such that they yield to impacts. This flexibility is acquired not because their connection to the spreader 2 or the possible driving system thereof, but because the combination of:

- The use of elastic materials: rubber, gum, Teflon, textile, elastomer composite materials and the like, either having a homogeneous composition or being reinforced with metallic or any other type of fibres.
- Modification of the flipper 3 geometry. Using sheets (spring plates) instead of one piece plates, such that deformation against impacts is enhanced. Use of profiles, either open or close, arranged to achieve the suitable combination of in-service rigidity, shock absorption and flexibility against impacts.

It is not always essential to use especial profiles or geometries in order to achieve the desired effect, but this will depend on the cargo to be transported, spreader 2 weight and service speed. In certain applications, using an elastomer to make a portion of the flipper 3 will be enough. In other applications with higher requirements this will not be enough for an optimal operation.

Flippers 3 are disclosed which yield but are not broken or plastically deformed. They are intended not to be dented, bent or deformed anyway, such that operation thereof is not forced to stop. It is searched to achieve an elastic element which is unbreakable while in service. This is particularly useful in critical machinery such as big dock container 1 cranes, the stop of which implies slowing down or stopping all the dock operation, affecting the ship, yard cranes, trucks and other machinery.

It is inevitable that the flippers 3 smash against the container 1. Sometimes this is something positive, since the direct impact of the spreader 2 with the container 1 could cause damage in one or the other being more serious than breaking the flipper 3. The flipper 3 plays, consequently, a certain role as a shock absorber although this is reduced with the current concept.

For example, flippers 3 are used which consist of three portions screwed to each other: a central area 4 or spring plate, a first end 5 attachable to the spreader 2, and a second end 6 acting as centering elements over the container, see FIG. 5, with the portion that couples to the spreader 2 and the sheets acting as centering elements themselves being more robust. Thus, most of the damage only affect to the central area 4 (the spring plate of the flipper 3), avoiding damage to the most valuable or main elements (load and spreader 2). The object of this application is to go a step further and make the impacts received not render the spring plates or flippers 3 useless, keeping and improving the current performance properties. Not only the flipper 3 itself is improved, but this becomes an authentic shock absorbing element to avoid damage in the most important and expensive elements.

It is essential that the flipper 3 continues playing its role as a centering element and guide for the twistlocks. Because of that, the element must be flexible and elastic against impacts and overloads, but it must be rigid against loads and habitual impacts while in service. In order to do so, it is very useful to provide the flipper 3 with a collapsible geometry. That is, a profile which buckles when reaching certain load either by flexure, torsion or pressure.

Summing up, an elastic flipper 3 is disclosed, being unbreakable in service, which absorbs the impacts, yield to impacts but keeps rigidity for the usual operation thereof. This is achieved by combining elastic materials, sheets, profile sections and elastic pieces with metallic cores or lattice.

This is achieved by combining elastic materials, sheets, profiled sections and elastic pieces having metallic cores or lattice. The advantages achieved are:

- Reducing the amount of flippers 3 to be repaired, either because of breakage or deformation.
- Reducing the imperfections on the machinery and the spreader 2 structure.
- Absorbing the impacts upon the container 1 and the load.
- Significantly reducing the number of hours wasted and loss of profit in the operation. It must be noted that the flippers 3 are usually installed in essential machinery, the delay of which directly implies a reduction of the production.
- Obtaining a safer device with respect to the operators. As it can be appreciated in FIGS. 3 and 4, the flipper 3 is an element protruding from the assembly, being easier that it hits people in case of carelessness from an operator or malfunction of the machinery.
- Similarly, it is also intended to reduce damage caused by impacts upon other elements which are in the spreader 2 working area: trucks, fork lift trucks, other containers 1, ships and crane elements.
- Substituting an element characterized by an operational fault thereof, with the corresponding loss for corrective maintenance, by another being more characterized by the wear thereof, more susceptible of preventive or predictive maintenance, performed at programed stops.

DESCRIPTION OF THE FIGURES CONTENT

FIG. 1—Spreader 2, container 1, flipper 3 in a retracted position and latching twistlock.

Figure 2:
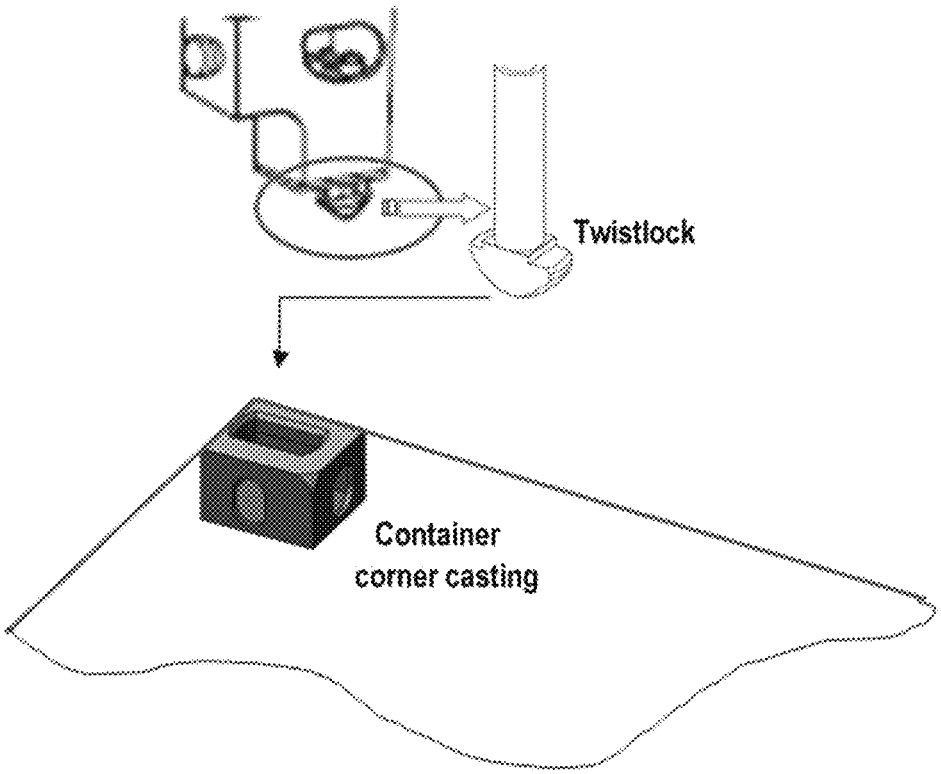

FIG. 2—Detail of the twistlock and socket.

Figure 3:
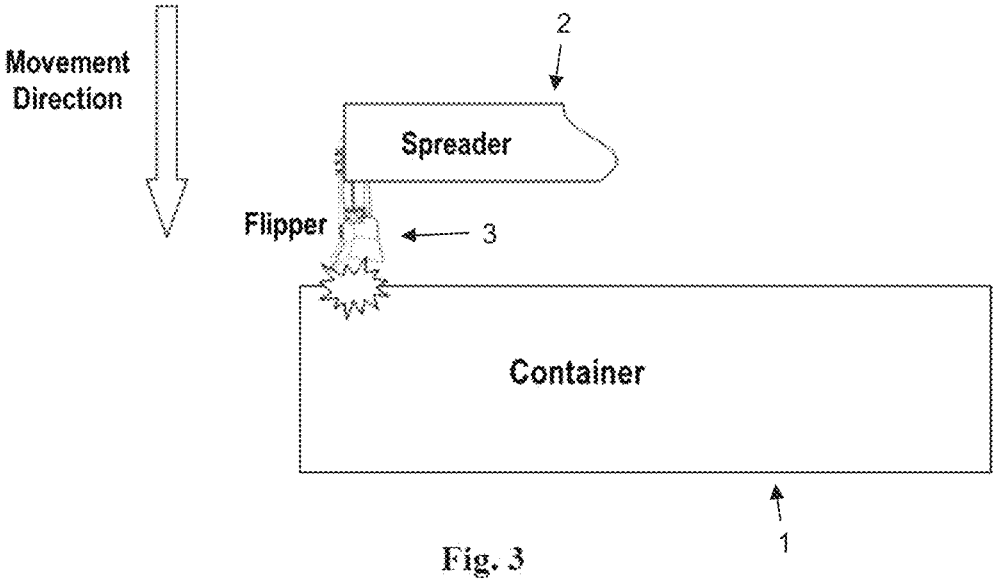

FIG. 3—Impact between the flipper 3 and the container 1 because of misaligned vertical approximation.

Figure 4:
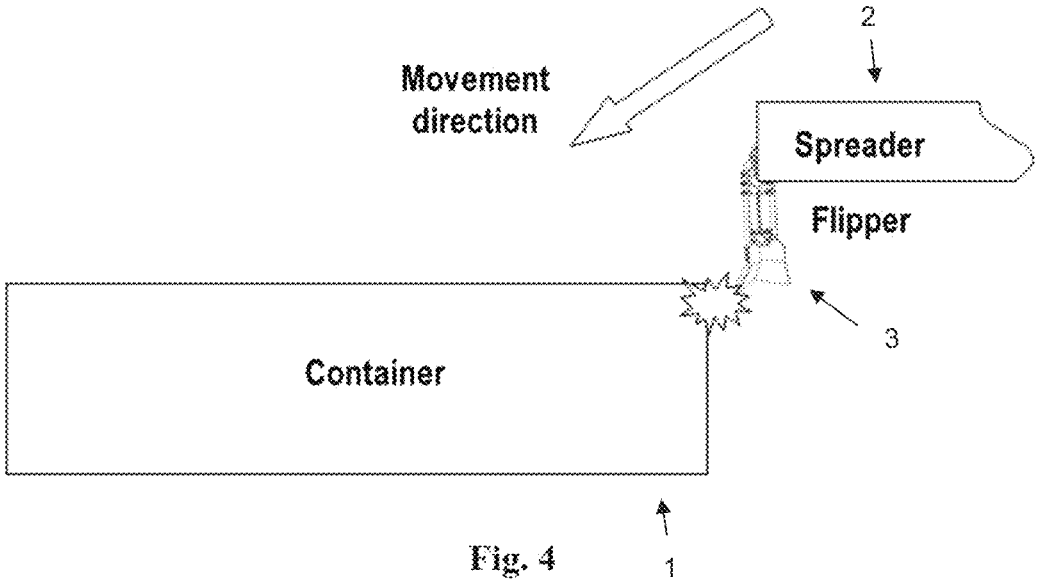

FIG. 4—Impact between the flipper 3 and the container 1 because of incorrect horizontal approximation.

FIG. 5—Model of a flipper 3 being formed by three screwed portions.

FIG. 6—Commercial models of flippers 3.

Figure 7:
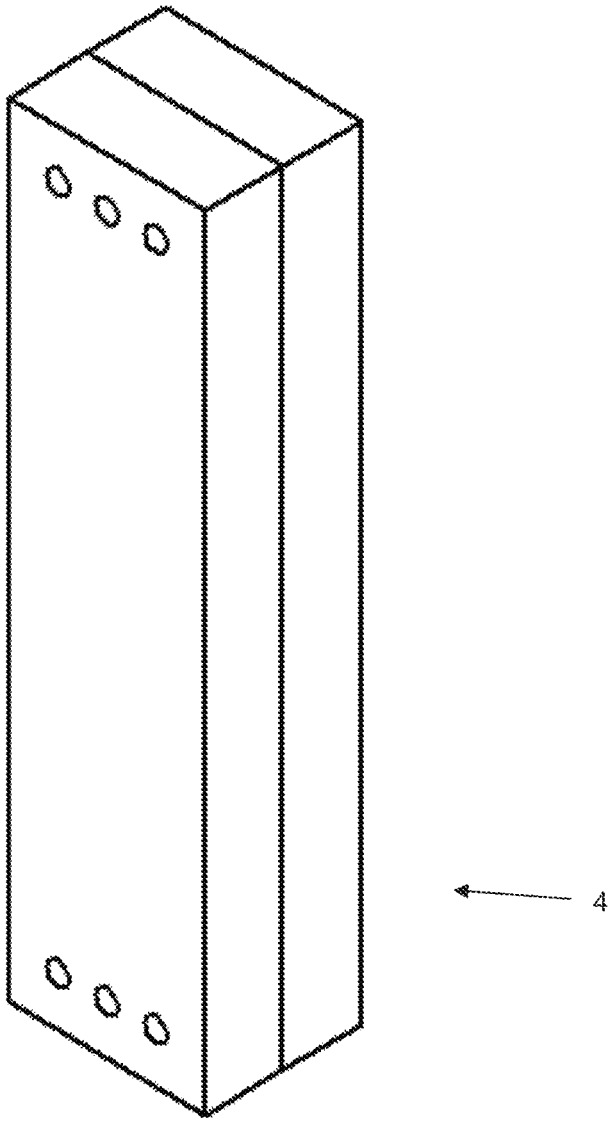

FIG. 7—More basic embodiment of the idea.

Figure 8:
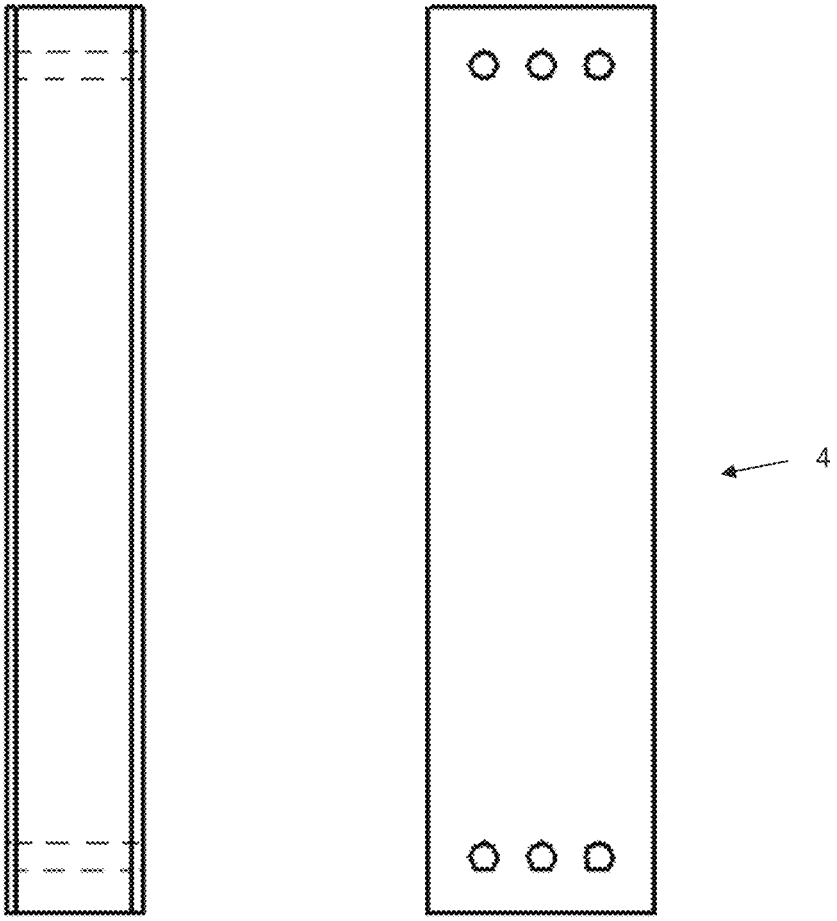

FIG. 8—Example of an embodiment using sheets.

Figure 9:
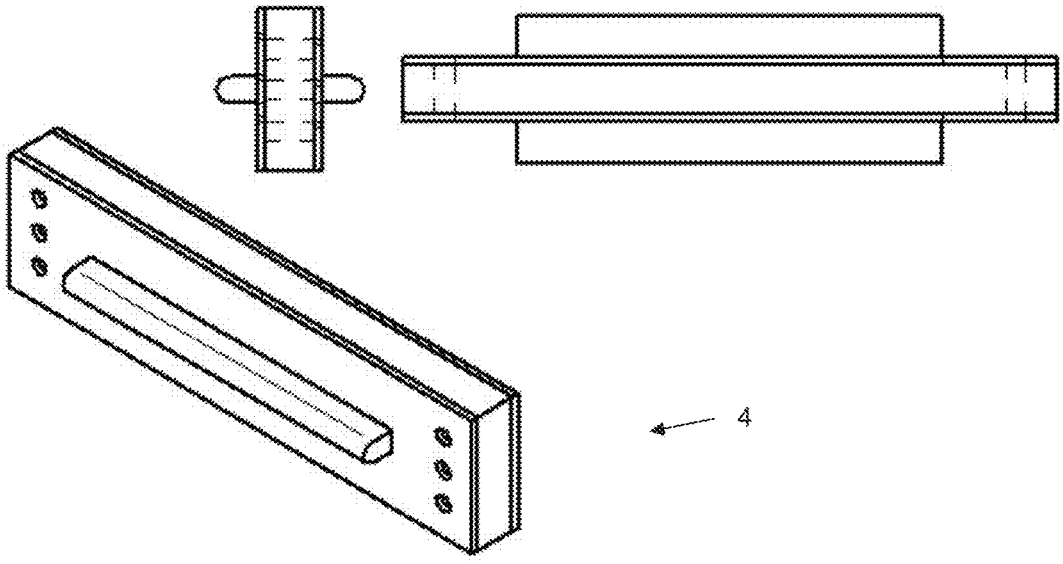

FIG. 9—Example of an embodiment formed as a cross arm.

EMBODIMENT OF THE INVENTION

The basic exemplary embodiment of the invention consists of substituting the intermediates plates in the flipper 3 (see FIG. 6) by two or more elastomeric material sheet, of the type of synthetic rubber, for example FKM (Fluorocarbon Rubber). In this case, the bolt arrangement is respected and the total thickness is increased, from 50 to 100 mm according to the type of service. The embodiment will be limited, in this case, to a pair of parallel assemblies, as that shown in FIG. 7.

A more elaborated variant consists of using at least three layers of material in each spring plate or central area 4 of the pair (see FIG. 8). The two outer thin layers are made of a composite material plus one or more soft rubber inner layers. The outer layers can be, by way of example, 5 mm thick, based on synthetic rubber comprising textile lattice and being longitudinally ribbed with steel wire. The purpose thereof is to resist traction and to provide the core with protection from sunlight, dust, dirt, etc. The inner layers, featuring a total thickness of about 40 or 60 mm, are in charge of providing rigidity for the usual operation and of making the elastic recovery easier after impact or overload deformation. For the outer layers, ribbed sheets rather than smooth sheets can be used.

A third variant is to use an elastic piece as the core which is cross-shaped, I profiled, H profiled or may have other geometries, which features a considerable geometric rigidity but which buckles against overload or impact. The variant is represented in FIG. 9. Finally, the possibilities with best perspectives are those combining the above variants: Flippers 3 (in one-piece or removable parts) the central area 4 of which is made of an elastic material comprising a deformable framework embedded therein, or else a lattice made of textile, metallic, plastic fibres or fibres of any other type. Thus, a more resistant, long-lasting and rigid assembly is achieved under normal operation; keeping the collapsible geometry characteristic against impacts, and always keeping the shock absorbing material capacity of the assembly.

All the variants mentioned above may be modified by making the whole flipper of an elastic material, or else render the flipper 3 central area 4 and centering element as one piece, or any other conceivable variant thereof that follows the concept of the elastic flipper 3 developed herein.

INDUSTRIAL APPLICATION

The invention can be applied in all those activities involving container 1 transport, lifting or handling operations. For example, container 1 terminals (maritime, railway or land), ships, spreader 2 manufacturers requiring the use of positioning flipper 3 arms, and big business the supplies or goods of which are supplied in containers 1 and use container 1 handling machinery.

The invention claimed is:

1. A flipper for container spreaders, comprising:

a first end attachable to a spreader;

a second end configured to act as a centering element;

a central area connecting the first end and the second end, the central area comprising a plurality of spring plates, each spring plate comprising a plurality of elastomeric sheets, providing a profile which buckles when reaching a load by flexure, torsion or pressure, wherein the flipper is constructed with elastic material or elastomeric material, having a homogeneous composition or reinforced with textile, plastic or metallic fiber.

2. The flipper for container spreaders according to claim 1, wherein a rigidity of the flipper is obtained by increasing a width of the spring plate, wherein two or more elastomeric sheets are placed in parallel to each other.

3. The flipper for container spreaders according to claim 2, wherein the spring plate is constructed with only an elastomeric material, the total width of the sheets forming the spring plate is between 40 and 100 mm.

4. The flipper for container spreaders according to claim 1, wherein more than one type of elastomeric material is used for manufacturing the spring plate, said spring plate is configured in layers comprising:

two or more outer layers, longitudinally ribbed with steel wire, with an approximate thickness between 1 and 10 mm, featuring a smooth or ribbed sheet geometry; and one or more inner layers with an approximate thickness between 40 and 60 mm.

5. The flipper for container spreaders according to claim 1, wherein the spring plate is an elastomeric material, wherein the central area forms crossed arms, I profile, H profile, C profile, or grooved profile, open or closed, which buckle because of flexure, pressure, torsion or pressure when undergoing overload or impact.

6. The flipper for container spreaders according to claim 1, wherein the central area comprises a rigid framework made of metallic or plastic material which allows flexibility when embedded in an elastomeric material.

7. The flipper for container spreaders according to claim 1, wherein the central area comprises a lattice made of plastic, metallic, textile, plastic or other fibers embedded in the elastomeric material.

8. The flipper for container spreader according to claim 1, wherein the elastic material is rubber, gum, vinyl, textile, or combinations thereof.

* * * * *